US008419087B2

(12) United States Patent
Shen

(10) Patent No.: US 8,419,087 B2
(45) Date of Patent: Apr. 16, 2013

(54) MORTISE LOCK WITH DUAL REVERSE/LOCKOUT MECHANISM

(75) Inventor: Tony Shen, Corona, CA (US)

(73) Assignee: Newfrey, LLC, Newark, DE (US)

( * ) Notice: Subject to any disclaimer, the term of this patent is extended or adjusted under 35 U.S.C. 154(b) by 266 days.

(21) Appl. No.: 12/732,967

(22) Filed: Mar. 26, 2010

(65) Prior Publication Data

US 2011/0233942 A1 Sep. 29, 2011

(51) Int. Cl.
*E05C 1/02* (2006.01)
*E05C 1/08* (2006.01)
*E05C 1/12* (2006.01)

(52) U.S. Cl.
USPC .... 292/169; 292/137; 292/163; 292/DIG. 53; 292/DIG. 54

(58) Field of Classification Search ..... 292/137, 292/163, 170, 169, 169.13, 169.16, 169.22, 292/DIG. 53, DIG. 54, DIG. 64
See application file for complete search history.

(56) References Cited

U.S. PATENT DOCUMENTS

| | | | | |
|---|---|---|---|---|
| 3,934,435 | A * | 1/1976 | Gresham | 70/150 |
| 4,118,056 | A * | 10/1978 | Alexander | 292/169.17 |
| 4,437,695 | A * | 3/1984 | Foshee | 292/352 |
| 4,529,234 | A * | 7/1985 | Senften | 292/169.15 |
| 4,658,664 | A * | 4/1987 | Jacobs et al. | 74/422 |
| 5,911,460 | A * | 6/1999 | Hawkins et al. | 292/254 |
| 6,581,423 | B2 * | 6/2003 | Lin | 70/107 |
| 6,735,993 | B2 * | 5/2004 | Eller et al. | 70/224 |
| 6,877,783 | B2 * | 4/2005 | Atkinson et al. | 292/171 |
| 7,010,946 | B2 * | 3/2006 | Hahn | 70/111 |

* cited by examiner

*Primary Examiner* — Thomas Beach
*Assistant Examiner* — Nathan Cumar
(74) *Attorney, Agent, or Firm* — Ober, Kaler, Grimes & Shriver; Royal W. Craig; Christopher F. Lonegro

(57) ABSTRACT

A mortise lock incorporating a modular powerpack with dual independent return mechanisms, one for the inside operator and one for the outside, using linear springs, and with a lockout feature for selective "locking out" of the return mechanisms to accommodate external operators with built-in powerpacks.

11 Claims, 3 Drawing Sheets

MORTISE LOCK WITH DUAL REVERSE/LOCKOUT MECHANISM

BACKGROUND OF THE INVENTION

1. Field of the Invention

The present invention relates to mortise locks, and particularly to an improved powerpack for mortise locks having a dual-independent return mechanism for inner and outer door operators, and a lockout feature.

2. Description of the Background

A mortise (or mortice) lock requires a pocket (the mortise) to be cut into the door to which the lock is to be fitted. Mortise locks are popular in commercial and upscale residential buildings in the United States due to their security and flexibility.

A typical mortise lock includes a lock body installed inside the mortise pocket, lock trim including various designs of faceplates, inner and outer "operators" which may be doorknobs, levers or other external operators, a latch bolt which is extendable out from the lock body to lock the door, a latch bolt driving assembly for translating torque from the latch bolt operators into linear motion of the latch bolt, a keyed cylinder journaled into the lock body to lock the latch bolt, and a strikeplate installed on the door frame with holes aligned to the bolt. Many mortise locks additionally include a locking deadbolt for more security. There are many variations, and indeed one of the primary advantages of mortise locks is that they accept a wide range of various manufacturers' cylinders, trim and accessories.

Most mortise locks are configured so that the inner operator mounted on the inside and the outer operator mounted on the outside of the door can operate independently. The outside operator can either be rotated to retract the latch bolt, or locked against rotation to prevent retraction of the latch bolt. Preferably, the inside operator can always be rotated to retract the latch bolt. The operators turn the latch bolt driving assembly rotary motion to linear retraction of the latch bolt, and a "powerpack" is used to return the operators to their rest position after being rotated to open the door. The locking of the outside operator (against rotation to prevent retraction of the latch bolt) is usually controlled by an actuator, such as, for example, a push button or a pivoted toggle, which is exposed at the edge of the mortise lock. The manual actuator selectively engages the spindle, latch bolt driving assembly or other component so as to prevent rotation from the outside. The inside latch knob or handle is usually unaffected by the actuator and remains rotatable at all times.

Conventional powerpacks are simple helical torsion springs, which can be included either inside the mortise lock body (internal) or as part of the operator (e.g., integral to the external operator), but not both. Since mortise locks are intended to accept a wide range of various manufacturers' trim including external operators, and since many manufacturers supply external operators with built-in powerpacks, mortise lock manufacturers have traditionally had to maintain two types of mortise locks in inventory, one with and one without the internal torsion spring. Moreover, helical torsion springs are themselves problematic, inasmuch as they are relatively weak, exert increasing torsion with turning, have a short fatigue life, and non-adjustable torsion coefficient. Mortise locks need to live up to their reputation as high-security locks, and this demands utmost durability.

It would be greatly advantageous to provide the mortise lock with a modular powerpack incorporating independent return mechanisms, one for the inside operator and one for the outside, each using linear springs so that the force deflecting the spring is in direct proportion to the distance the spring travels, both allowing adjustable torsion, and further including a lockout feature for selective "locking out" of the internal return mechanisms to accommodate external operators with built-in powerpacks.

SUMMARY OF THE INVENTION

The present invention is a mortise lock incorporating a modular powerpack with dual independent return mechanisms, one for the inside operator and one for the outside operator. Rather than radial torsion springs, the powerpack uses two offset linear springs for the independent return mechanisms. In addition, the powerpack includes a lockout feature for selective "locking out" of the return mechanisms to accommodate external operators with built-in powerpacks.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
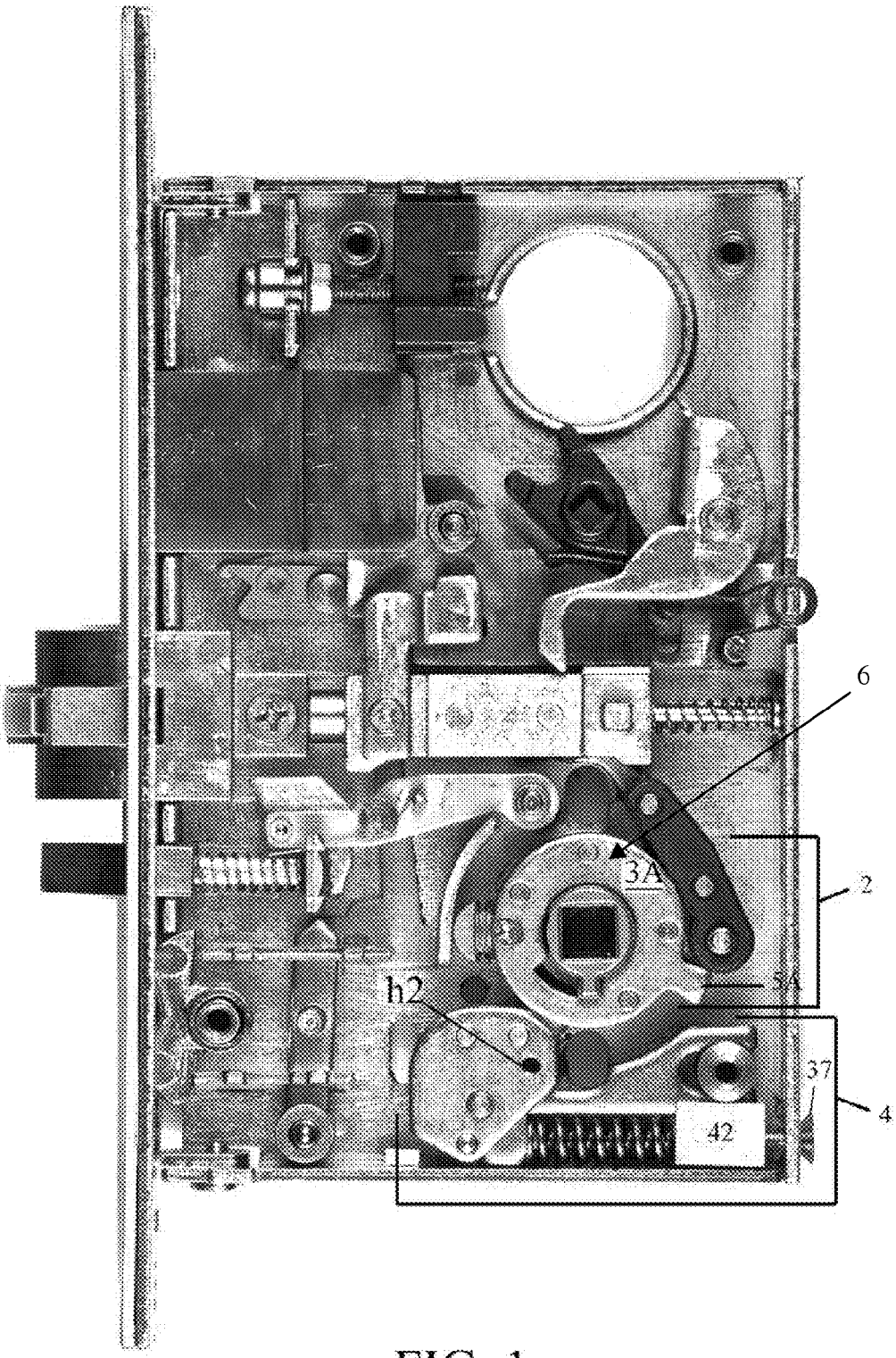
FIG. 1 is a front perspective view of the entire mortise lock including both latch actuator assembly 2 and powerpack 4 according to the present invention.

FIG. 1 is a front perspective view of the mortise lock incorporating the novel powerpack 4 according to the present invention, which is operative on the latch actuator assembly 2 to return it and the operator (door knob, handle, etc.) to their rest position after being rotated to open the door. The latch actuator assembly 2 includes an upper latch actuator 6 into which he exterior operator stem is journaled, and a lower latch actuator 7 (obscured in FIG. 1, see FIG. 2) into which the interior operator stem is journaled. The upper latch actuator 6 and lower latch actuator 7 are identical and mounted for coaxial but independent rotation. In the foregoing respects the latch actuator assembly 2 is conventional, but there is one modification. The modification comprises two cog protrusions 5A, 5B, one each extending from the upper latch actuator 6 and lower latch actuator 7 for engagement with 5 the powerpack 4 as will be described. In the illustrated latch actuator assembly 2, both the upper latch actuator 6 and lower latch actuator 7 are bounded by circular plates 3A, 3B and both cog protrusions 5A, 5B may be formed integral to these plates, protruding therefrom as squared tabs. In use the upper and/or lower latch actuators turn clockwise to retract the latch bolt and open the lock. In so doing the cog protrusion(s) 5A, 5B rotate clockwise, engage the powerpack 4, and displace it. 10 The powerpack 4 is spring loaded as will be described. Thus, once the door has been opened and the operator released, the powerpack 4 return-biases the upper and/or lower latch actuators back to their rest position.

Figure 2:
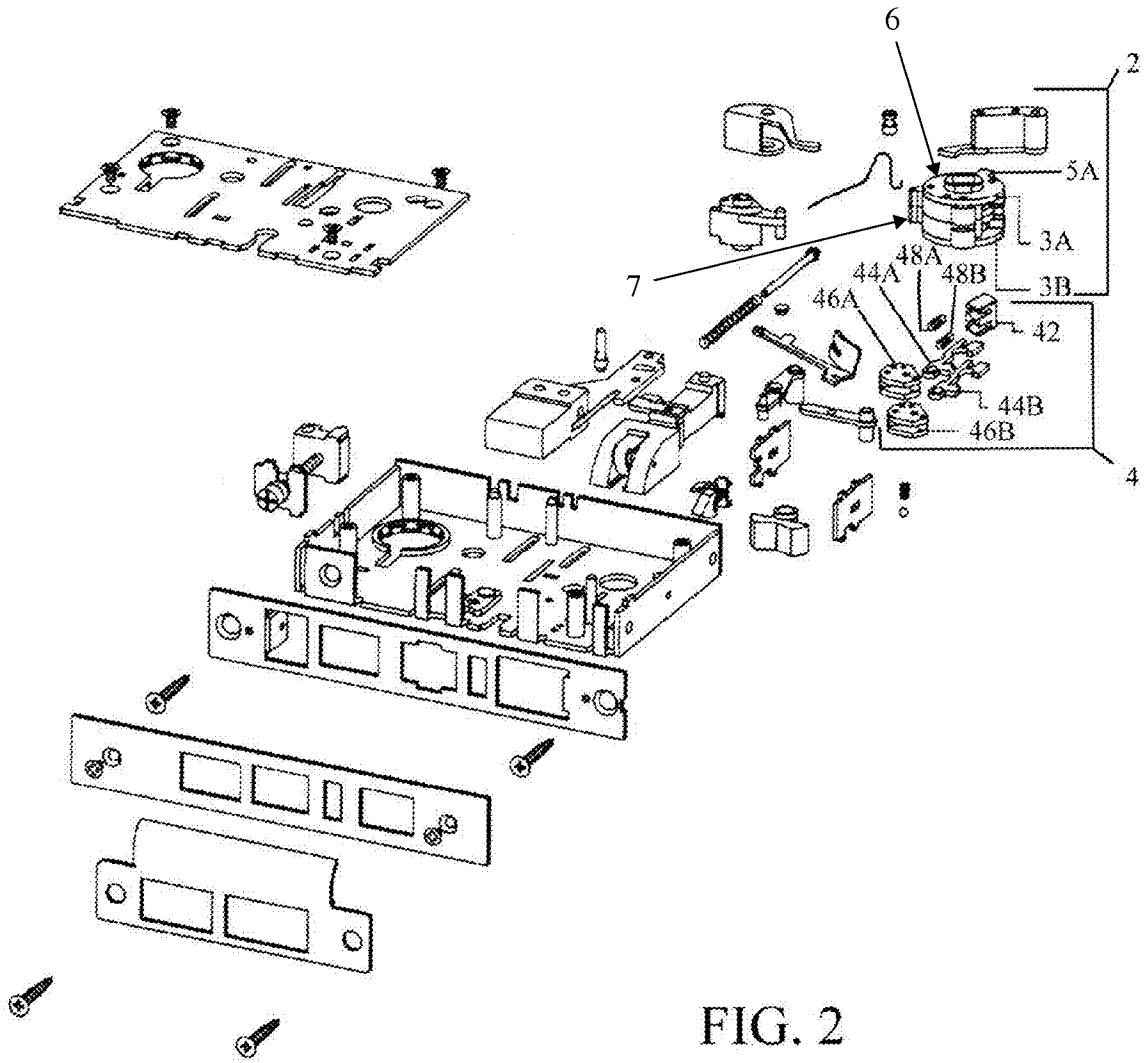
FIG. 2 is a perspective exploded view of the entire mortise lock including both latch actuator assembly 2 and powerpack 4.

FIG. 2 is a perspective exploded view of the entire mortise lock including components of both the latch actuator assembly 2 and powerpack 4. The circular plates 3A, 3B of the powerpack 4 can be seen with the cog protrusions 5A, 5B. According to the present invention, and unlike a torsion spring, the powerpack 4 employs linear springs that are offset from the axis of the latch actuator assembly 2. Powerpack 4 further comprises an upper reversing mechanism (A) and lower reversing mechanism (B) both comprised of like components, and operative on the upper latch actuator and lower latch actuator, respectively. The upper and lower reversing mechanisms components include upper and lower blockaged assemblies 46A, 46B, a pair of linear springs 48A, 48B, a single spring shoe 42, a pair of spring arms 44A, 44B, and a pair of set screws 47. The blockaged assemblies 46A, 46B each comprise a pinion formed as an eccentric disk with a catch-post for engaging the cog protrusions 5A, 5B of the actuator assembly 2. The blockaged assemblies 46A, 46B are rotatably mounted in a stacked configuration on a pin or post within the mortise housing, and pivot independently about a common axis which is offset from their center. The pair of linear springs 48A, 48B are both seated in the spring shoe 42. The spring shoe 42 provides a foundation for the springs 48A, 48B but floats within the bottom corner of the mortise housing, its precise position being set by a pair of set screws 47 threaded through the mortise housing and abutting the spring shoe 42. The springs 48A, 48B bias the pair of spring arms 44A, 44B. Spring arms 44A, 44B are coupled to the blockaged assemblies 46A, 46B and engage the blockaged assemblies 46A, 46B tangentially, so that the spring bias imparted by springs 48A, 48B via spring arms 44A, 44B opposes rotation of the blockaged assemblies 46A, 46B. The position of the spring shoe 42 and degree of spring bias imparted is set by the length of set screws 47. The set screws 47 are of predetermined length, such that once inserted and fully tightened they stay in position, fixing the position of the spring shoe 42. The set screws 47 act as a positive stop for the spring shoe 42 in opposition to the bias of the compression springs 48A, 48B there against. The set screws 47 are intended to stay in position and are not intended to be field-adjustable. Nevertheless, when necessary the original set screws 47 can be replaced by different length screws, thereby altering the position of the spring shoe 42 as needed.

In operation, when the outer operator is turned clockwise from its home position it will rotate the upper latch actuator of latch actuator assembly 2, and when inner operator is turned it will rotate the lower latch actuator of latch actuator. In either case, the latch actuator of latch actuator assembly 2 rotates clockwise until the cog protrusion 5A, 5B engages the respective blockaged assemblies 46A, 46B. The cog protrusion 5A, 5B pulls the respective blockaged assembly 46A, 46B counterclockwise about its pivot, against the tangential bias of springs 48A, 48B and spring arms 44A, 44B. As the latch actuator assembly 2 continues to rotate clockwise the blockaged assembly 46A, 46B rotates counterclockwise. This pushes against the spring arms 44A, 44B and compresses the springs 48A, 48B against the spring shoe 42. Since the springs 48A, 48B are linear, the amount of bias exerted by each increases linearly with operator rotation to give the user a consistent feel. Moreover, the bias is adjustable by screws 47 which adjust spring shoe 42. If an installer wishes to disable the powerpack 4 entirely to adapt the mortise lock for use with inner/outer operators pre-equipped with internal powerpacks, this can be easily done simply by inserting a pin through the housing and through the small hole h2 (see FIG. 1) in each of the blockaged assemblies 46A, 46B (while in their fully biased position) to disable their operation. The powerpack 4 is modular and uses redundant parts to provide fully independent return mechanisms, one for the inside operator and one for the outside, linear springs 48A, 48B (as opposed to torsion springs) so that the force deflecting the spring is in direct proportion to the distance the spring compresses, and a simple but convenient lockout mechanism for selective "locking out" of the return mechanisms to accommodate external operators with built-in powerpacks.

Figure 3:
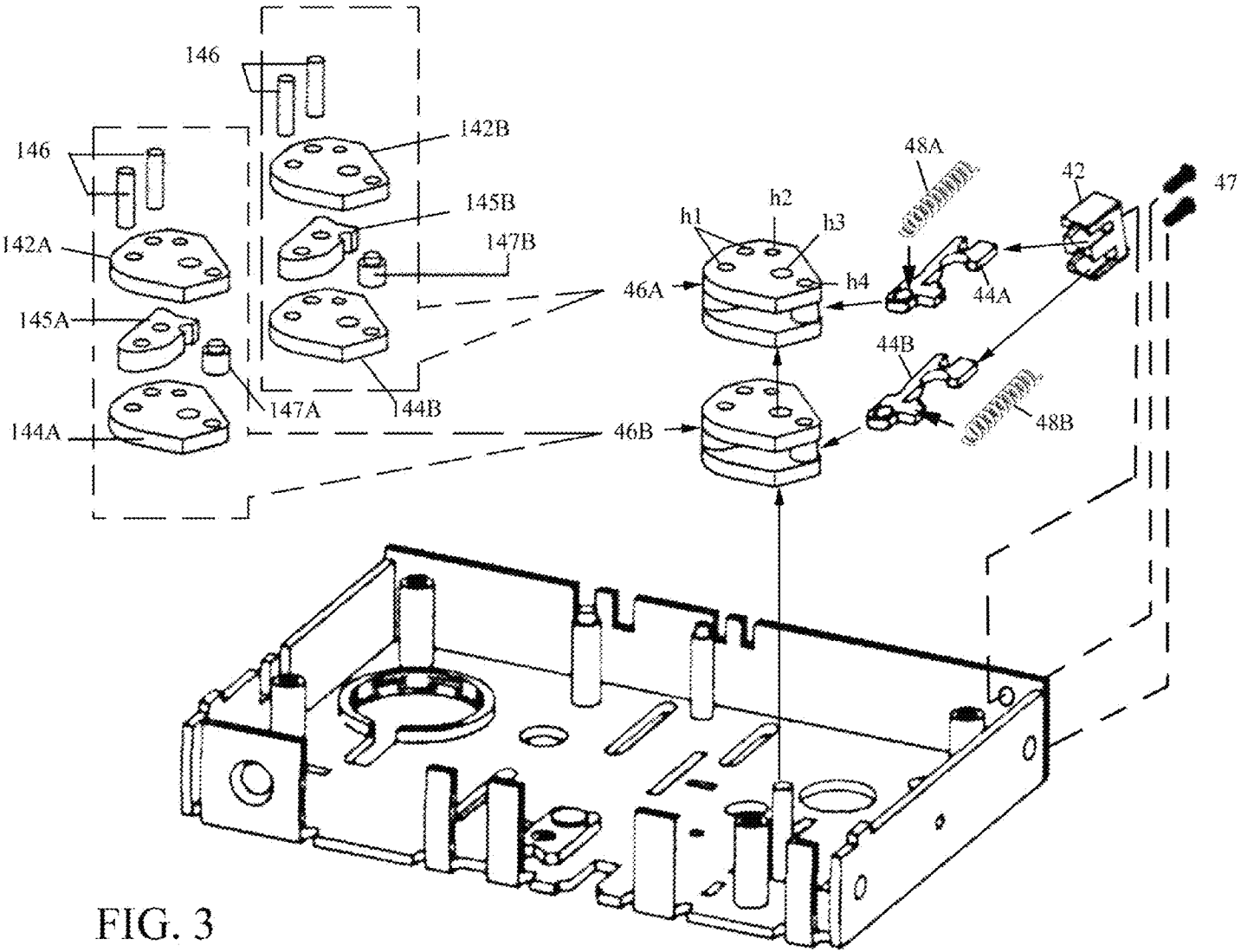
FIG. 3 is an enlarged perspective exploded view of the powerpack 4 further illustrating the components of the blockaged assemblies 46A, 46B.

FIG. 3 is an enlarged perspective assembly view of the powerpack 4 further illustrating the components of the blockaged assemblies 46A, 46B. Each blockaged assembly 46A, 46B is identical and comprises an upper blockage plate 142A, 142B, a lower blockage plate 144A, 144B, an intermediate shoulder 145A, 145B sandwiched between the respective upper and lower blockage plates 142A, 144A and 142B and 144B, a plurality of compression pins 146 (here one pair each) for securing the plates together, and posts 147A, 147B offset from the shoulders 145A, 145B and straddling the upper and lower blockage plates 142A, 144A and 142B and 144B, respectively.

All four of the upper blockage plates 142A, 142B and lower blockage plates 144A, 144B are identical and each comprises an eccentric flat and substantially oval disk-member defined by a plurality of through-holes (h) including one or more peripheral through-holes (h1) for insertion of the compression pins 146, one opposing through-hole (h4) for seating the posts 147A, 147B, one or more through-holes (h2) for insertion of a lockout pin, and one through-hole (h3) offset from center for insertion of a pivot pin. The post 147A, 147B is a cylindrical post with narrower end-pins compression fit into the through-hole (h4) on one side of the pivot (h3) and sandwiched between the blockage plates 142A, 142B and 144A, 144B: The posts 147A, 147B serve as spacers separating the upper blockage plates 142A, 142B and lower blockage plates 144A, 144B, and also as the pinion-catch-post for engaging the cog protrusions 5A, 5B of the actuator assembly 2 as they rotate past. The compression pins 146 simply hold the upper blockage plates 142A, 142B and lower blockage plates 144A, 144B in their sandwiched configuration with shoulders 145A, 145B there between. The shoulders 145A, 145B are primarily spacers equal in thickness to the posts 147A, 147B, and are likewise defined by through-holes for passing the compression pins 146 and for the lockout pin (not shown). When assembled, the blockaged assemblies 46A, 46B appear as to the right and both are pivotally mounted in a stacked configuration within the mortise housing, and pivot independently about a common axis which is offset from center. The pair of linear springs 48A, 48B may be conventional compression springs and both are seated at one end in the spring shoe 42. The spring shoe 42 itself is a block formed of molded plastic, metal or other suitable material with side-by-side frontal cavities for seating the springs 48A, 48B. The springs 48A, 48B are affixed to a pair of spring arms 44A, 44B, each spring arm comprising an elongate member having a protruding head for engagement with the posts 147A, 147B of the blockaged assemblies (the head may be yoked about the posts 147A, 147B), and a pair of sidelong-protruding tabs about which the springs 48A, 48B are wound for channeling the springs 48A, 48B into the spring shoe 42 and maintaining them linear. The springs 48A, 48B are attached to the foremost tab. The spring shoe 42 floats within the mortise housing and its position is set by a pair of set screws 47 threaded through the mortise housing and abutting the spring shoe 42 from the rear. The springs 48A, 48B impart an individual linear bias to the respective spring arms 44A, 44B away from the spring shoe 42, and by virtue of the spring arm 44A, 44B engagement/coupling to the blockaged assemblies 46A, 46B will oppose any clockwise rotation of the blockaged assemblies 46A, 46B. Again, the degree of spring bias imparted can be adjusted by positioning the spring shoe 42 via set screws 47. Thus, when the cog protrusions 5A, 5B of the latch actuator assembly 2 pull the respective blockaged assembles 46A, 46B counterclockwise about its pivot, the tangential bias of springs 48A, 48B and spring arms 44A, 44B will oppose it and when the door operator is released will return it to its rest position. Conversely, when an installer wishes to disable the powerpack 4 entirely (such as when the inner/outer operators are equipped with internal powerpacks), he may simply insert a pin through the housing and through the small hole 47 (see FIG. 1) in each of the blockaged assemblies 46A, 46B while in their fully biased position to disable their operation.

It should now be apparent that the above-describe modular powerpack for a mortise lock provides independent return mechanisms, one for the inside operator and one for the outside, both using linear springs so that the force deflecting the spring is in direct proportion to the distance the spring travels, and both of adjustable torsion, and also incorporating a simple lockout mechanism for selective "locking out" of the return mechanisms to accommodate external operators with built-in powerpacks.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A mortise lock, comprising:

a housing;

a latch bolt slideably retractable into said housing;

a latch actuator assembly including a first latch actuator mounted within said housing for rotation about a first axis and keyed to an outer door operator for translating rotary motion of said outer door operator from a rest position into linear retraction of said latch bolt, and a second latch actuator mounted within said housing for rotation about said first axis and keyed to an inner door operator for translating rotary motion of said inner door operator from a rest position into linear retraction of said latch bolt; and a powerpack engaged to said latch actuator assembly for biasing said inner and outer door operators back to said rest positions, said powerpack further comprising, a first pinion engageable with said first latch actuator and rotatably mounted in said housing on a second axis for rotation between a first position in which said outer door operator is in said rest position and a second position in which said outer door operator is displaced from said rest position sufficiently to retract said latch bolt, a first spring engaged to said first pinion for biasing said first pinion toward said first position, and a first pinion catch offset from said second axis for engaging said first latch actuator, and a second pinion engageable with said second latch actuator, said second pinion being rotatably mounted in said housing coaxial with said first pinion for rotation between a first position in which said inner door operator is in said rest position and a second position in which said inner door operator is displaced from said rest position to retract said latch bolt, a second spring engaged to said second pinion for biasing said second pinion toward said first position, and a second pinion catch offset from said second axis for engaging said second latch actuator.

2. The mortise lock according to claim 1, wherein said first latch actuator and second latch actuator each comprise a cog for engaging said first and second pinion catch, respectively.

3. The mortise lock according to claim 1, wherein said springs are linear springs.

4. The mortise lock according to claim 3, wherein said linear springs are seated in an adjustable-position spring shoe for varying spring-bias.

5. The mortise lock according to claim 1, wherein said first pinion and second pinion both comprise an identical pinion.

6. The mortise lock according to claim 5, wherein said pinions both comprise an eccentric disk.

7. The mortise lock according to claim 6, wherein said pinions both comprise an upper disk plate, a lower disk plate, and an intermediate member.

8. The mortise lock according to claim 7, wherein said pinions both comprise a catch post for engaging the cogs of said first latch actuator and second latch actuator.

9. The mortise lock according to claim 1, wherein said first and second pinions each comprise a lockout mechanism by which said first pinion and second pinion are selectively retained in said second position.

10. The mortise lock according to claim 9, wherein said lockout mechanism comprises a first hole in said pinion and a second hole in said housing, said first and second holes in cooperative alignment when said pinion is in said second position and a pin selectively inserted through said first and second holes to prevent pivoting of said pinions from said second position.

11. The mortise lock according to claim 9, wherein each said lockout mechanism comprises an engagement with said housing.

* * * * *